US009308437B2

(12) United States Patent
Carter

(10) Patent No.: US 9,308,437 B2
(45) Date of Patent: Apr. 12, 2016

(54) ERROR CORRECTION SYSTEM AND METHOD FOR A SIMULATION SHOOTING SYSTEM

(71) Applicant: George Carter, Dallas, TX (US)

(72) Inventor: George Carter, Dallas, TX (US)

(73) Assignee: Tactical Entertainment, LLC, Dallas, TX (US)

( * ) Notice: Subject to any disclaimer, the term of this patent is extended or adjusted under 35 U.S.C. 154(b) by 0 days.

(21) Appl. No.: 14/606,640

(22) Filed: Jan. 27, 2015

(65) Prior Publication Data

US 2015/0141100 A1 May 21, 2015

Related U.S. Application Data

(63) Continuation-in-part of application No. 14/498,112, filed on Sep. 26, 2014, which is a continuation-in-part of application No. 14/168,951, filed on Jan. 30, 2014, now Pat. No. 8,888,491, which is a continuation-in-part of application No. 13/611,214, filed on Sep. 12, 2012, now Pat. No. 8,678,824, which is a continuation-in-part of application No. 12/608,820, filed on Oct. 29, 2009, now Pat. No. 8,459,997.

(60) Provisional application No. 61/156,154, filed on Feb. 27, 2009.

(51) Int. Cl.

| | |
|---|---|
| ***A63F 9/02*** | (2006.01) |
| ***F41A 33/00*** | (2006.01) |
| ***F41G 3/26*** | (2006.01) |

(52) U.S. Cl.

CPC ..... *A63F 9/0291* (2013.01); *F41A 33/00* (2013.01); *F41G 3/26* (2013.01)

(58) Field of Classification Search

CPC ..... F41G 1/00; F41G 3/26; F41A 33/00; F41A 33/02; F41A 33/04; F41A 33/06

See application file for complete search history.

(56) References Cited

U.S. PATENT DOCUMENTS

| | | | | |
|---|---|---|---|---|
| 5,215,462 | A | 6/1993 | Lewis et al. | |
| 6,813,593 | B1 | 11/2004 | Berger | |
| 6,899,539 | B1 | 5/2005 | Stallman et al. | |
| 7,329,127 | B2 | 2/2008 | Kendir et al. | |
| 8,794,967 | B2 * | 8/2014 | Sargent | A63F 13/06 434/11 |
| 2003/0222150 | A1 * | 12/2003 | Sato | G06F 1/1626 235/472.02 |
| 2005/0153262 | A1 * | 7/2005 | Kendir | 434/21 |
| 2007/0190494 | A1 * | 8/2007 | Rosenberg | A63F 13/12 434/11 |
| 2007/0190495 | A1 * | 8/2007 | Kendir et al. | 434/21 |
| 2009/0009945 | A1 * | 1/2009 | Johnson et al. | 361/681 |
| 2009/0305197 | A1 * | 12/2009 | Lim et al. | 434/16 |

* cited by examiner

*Primary Examiner* — Timothy A Musselman
(74) *Attorney, Agent, or Firm* — Michael L. Diaz

(57) ABSTRACT

An error correction system for a shooting simulation system. The error correction system includes a mechanism for gathering and storing historical data of a communication device utilized in a shooting simulation system. The historical data includes hit and miss results of the communication device in a targeting of a target over a predetermined period of time. The system also includes a processor for analyzing the historical data of the communication device to determine errors caused by the communication device. The processor determines an error correction to correct the errors caused by the communication device. The processor then implements the error correction to determine a hit or miss of a targeting of a target. The error correction system may also utilize historical data from shots taken by a shooter and motion of the communication device being aimed immediately prior to targeting a target to determine an appropriate error correction.

14 Claims, 11 Drawing Sheets

ERROR CORRECTION SYSTEM AND METHOD FOR A SIMULATION SHOOTING SYSTEM

RELATED APPLICATIONS

This application is a continuation-in-part application of co-pending U.S. patent application Ser. No. 14/498,112 entitled "Simulated Shooting System and Method" filed Sep. 26, 2014 under the name of George Carter which is a continuation-in-part of U.S. Pat. No. 8,888,491 entitled "An Optical Recognition System and Method For Simulated Shooting" filed on Jan. 30, 2014 under the name of George Carter which is a continuation-in-part application of U.S. Pat. No. 8,678,824 entitled "Shooting Simulation System and Method Using an Optical Recognition System" filed on Sep. 12, 2012 under the name of George Carter which is a continuation-in-part application of U.S. Pat. No. 8,459,997 entitled "Shooting Simulation System and Method" filed on Oct. 29, 2009 under the name of George Carter which claims the benefit of U.S. Provisional Patent Application Ser. No. 61/156,154 filed Feb. 27, 2009 by George Carter, all of which is hereby incorporated by reference.

BACKGROUND OF THE INVENTION

1. Field of the Invention

This invention relates to simulation systems and methods. Specifically, and not by way of limitation, the present invention relates to an error correction system and method for simulated shooting systems. Additionally, the present invention relates to a targeting actuation system for actuating the shooting system.

2. Description of the Related Art

There are numerous laser tag games utilizing Infrared (IR) emitters and sensors for playing various forms of tag. U.S. patent application Ser. No. 14/498,112 entitled "Simulated Shooting System and Method" provides for a novel system and method utilizing ordinary mobile phones for playing various forms of tag. However, there are errors in accurately determining a hit or miss when utilizing current location and directional devices in mobile phones.

There are two main errors to the shooting system. First, there are GPS errors (positional) for both the shooter and the target which occur for various reasons. The GPS offset errors tend to result in the same or a similar offset for both the target and shooter. Additionally, oftentimes these errors diminish with time. The second type of errors is caused by the directional devices, such as magnetometers, used in the mobile phones. It is common for these errors to remain similar for a particular heading while changing for different headings. For example, aiming the mobile phone to the North may provide one type of error, (e.g., a 10 degree left error) while aiming the mobile phone to the South may produce a significantly different error (e.g., a 20 degree right error).

It would be advantageous to a have system and method for correcting these errors inherent with the present invention's shooting system. It also would be advantageous to have a system and method for correcting these errors which utilize historic data of a particular shooter to determine if a correction should be employed for an accurate shooter while disregarding an error correction for an inaccurate shooter. It is an object of the present invention to provide such a system and method.

SUMMARY OF THE INVENTION

In one aspect, the present invention is directed to an error correction system for a shooting simulation system. The error correction system includes a mechanism for gathering and storing historical data of a communication device utilized in a shooting simulation system. The historical data includes hit and miss results of the communication device in a targeting of a target over a predetermined period of time. The error correction system also includes a processor for analyzing the historical data of the communication device to determine errors caused by a Global Positioning System (GPS) and errors caused by a mechanism for determining a directional orientation of the communication device during targeting of a target. The processor determines an error correction to correct the errors caused by the GPS and errors caused by the mechanism for determining a directional orientation. The processor then implements the error correction to determine a hit or miss of a targeting of a target by the communication device. In another embodiment of the present invention, the error correction system may utilize historical data from shots taken by a shooter and motion of the communication device being aimed immediately prior to targeting a target to determine an appropriate error correction.

In another aspect, the present invention is directed to a method of implementing an error correction for a shooting simulation system utilizing a communication device for targeting of a target. The method begins by gathering and storing historical data of the communication device utilized in a shooting simulation system. The historical data includes hit and miss results of the communication device in a targeting of a target over a predetermined period of time. The historical data of the communication device is analyzed to determine errors caused by a Global Positioning System (GPS) and errors caused by a mechanism for determining a directional orientation of the communication device when aimed. An error correction is then determined to correct the errors caused by the communication device. The error correction is then implemented to determine a hit or miss of a targeting of a target by the communication device. In another embodiment, historical data of shots taken by a shooter of the communication device and motion of the communication device being aimed immediately prior to targeting a target to is utilized to determine an appropriate error correction.

In another aspect, the present invention is directed to a targeting actuation system for a shooting simulation system having a communication device for targeting of a target. The targeting actuation system includes a main case configured for accommodating and retaining the communication device and a mechanism coupled to the main case for actuating the targeting of a target. In one embodiment, the targeting actuation system may include a cover sized and shaped to cover an optical screen of a communication device with openings to allow partial viewing of relevant portions of the optical screen. In another embodiment, the targeting actuation system includes a grip and trigger for actuating the targeting of a target in the shooting simulation system.

DESCRIPTION OF THE INVENTION

Figure 1:
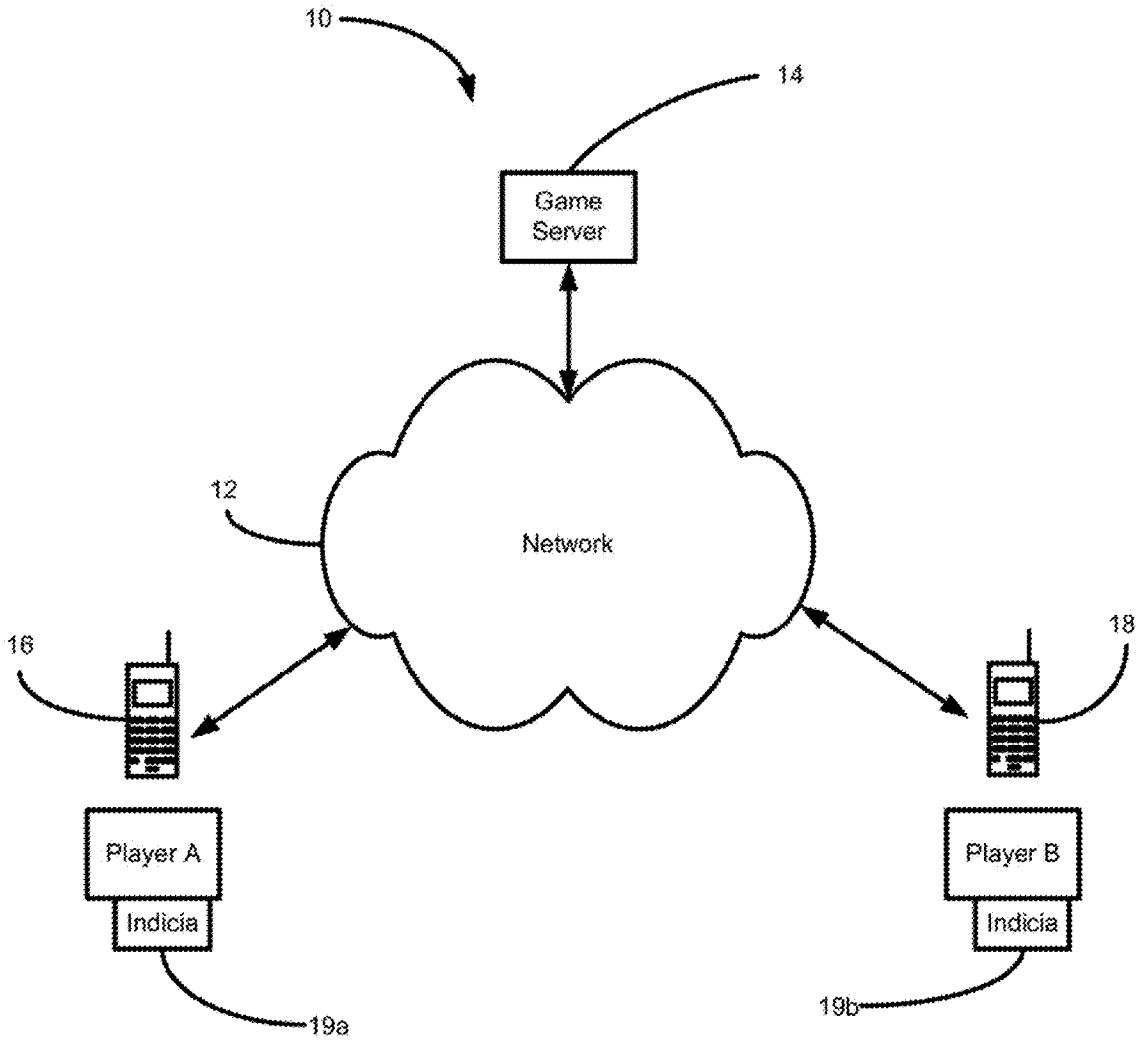
FIG. 1 is a simplified block diagram of a shooting simulation system.

In one embodiment, the present invention is a targeting actuation system. FIG. 1 is a simplified block diagram of a shooting simulation system 10 in one embodiment of the present invention. The system 10 includes a wireless network 12, a game server 14, and a plurality of mobile phones 16 and 18. The wireless network 12 may be any wireless communications network, such as a cellular network, any type of telecommunications network, Wi-Fi, etc. The game server 14 is a computing device communicating with the plurality of mobile phones 16 and 18 via the network 12. The mobile phones 16 and 18 may be any communication device capable of communicating via the wireless network, such as a tablet, phablet, portable computer, etc. It should be understood that the term "mobile phone" shall encompass any of these communication devices. Furthermore, two mobile phones are depicted, however any number of mobile phones may be utilized in the present invention. In addition, each mobile phone may function as a simulated firearm or aiming/targeting device for a simulated airborne weapon system, such as a notional airborne drone. Additionally, each mobile phone is carried by a player. As shown in FIG. 1, the mobile phone 16 is associated with a player A and mobile phone 18 is associated with a player B.

In one embodiment, each player A and B includes a specific indicia 19 (19*a* is associated with player A and indicia 19*b* is associated with player B) associated with the player. The indicia 19 may be any type of indicia to include color codes, bar codes, the shape of a helmet, shape of a typical person's face, infrared signatures, modulating retro-reflectors (MRRs), and other spectral images. Additionally, indicia may include the identification of a target silhouette. However, in the preferred embodiment of the present invention, the indicia provide a geographical position and optionally an identification of the mobile phone and its associated player.

Figure 2:
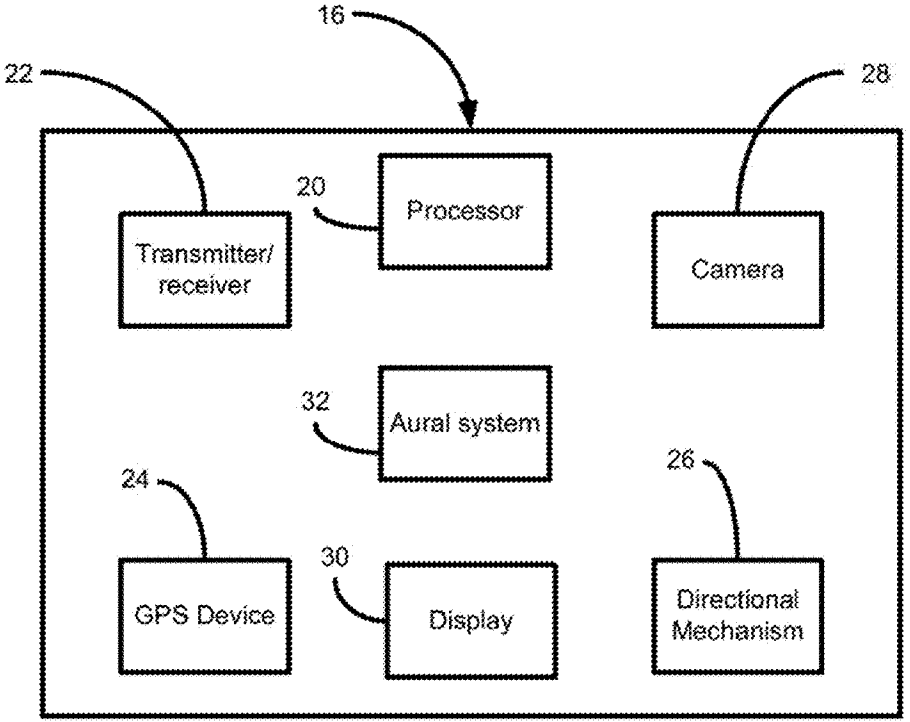
FIG. 2 is a simplified block diagram of the components of a mobile phone in one embodiment of the present invention.

FIG. 2 is a simplified block diagram of the components of a mobile phone in one embodiment of the present invention. The mobile phone 16 includes a processor 20, a transmitter/receiver 22, a Global Positioning System (GPS) device 24, a directional mechanism 26 for determining a directional orientation of an aimed mobile phone, and an optional camera 28. The directional mechanism may be incorporated into the GPS device or be a separate component utilizing one or more accelerometers or a magnetometer to ascertain a direction of the aimed mobile phone. The processor 20 may be any computing device and incorporate the use of a software application, mobile application (e.g., "app") to accomplish the functions of the present invention.

Figure 3:
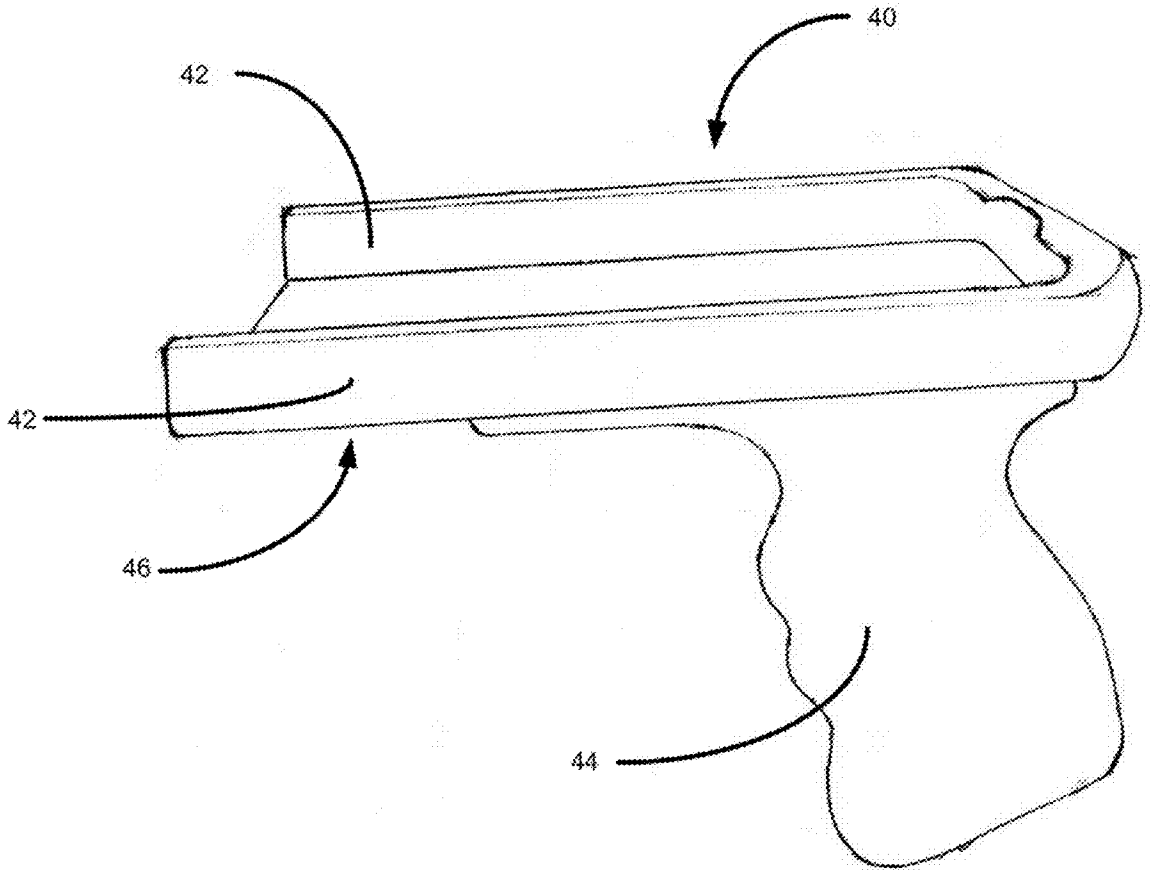
FIG. 3 is a front perspective view of a mobile phone case for use with the mobile phone.
Figure 4:
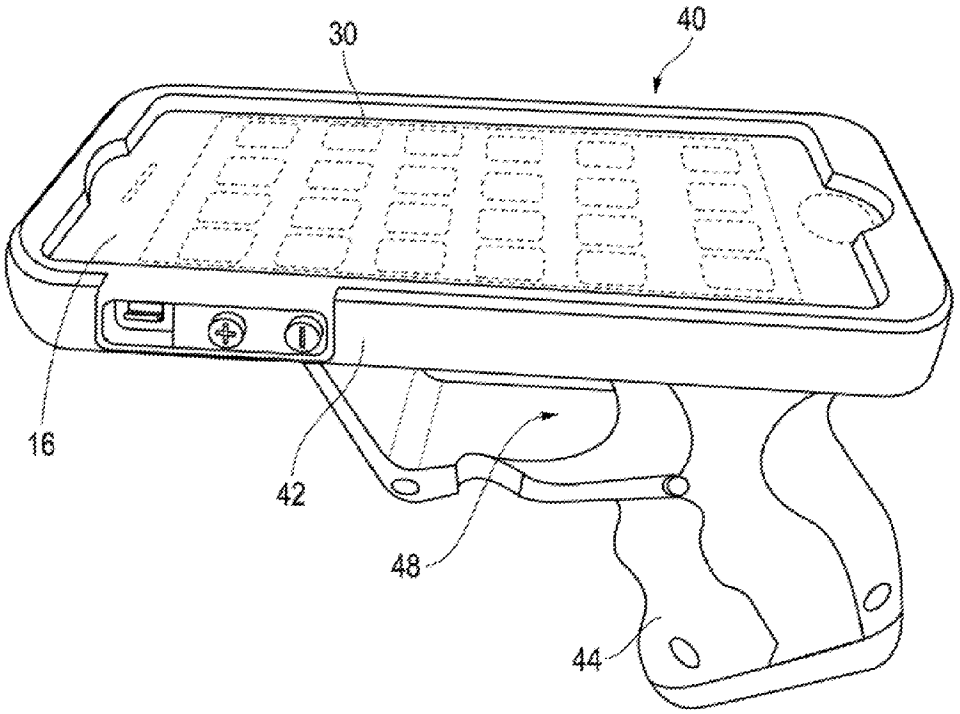
FIG. 4 is a front perspective view of the mobile phone inserted within the case of FIG. 3.

The mobile phone may be a firearm facsimile or affixed to a device to simulate a firearm. In another embodiment, the mobile phone is a targeting device for targeting a target for a strike by a notional airborne drone. FIG. 3 is a front perspective view of a mobile phone case 40 for use with the mobile phone 16. The case 40 includes a mobile phone case sized and shaped to accommodate a mobile phone. The case is similar to many cases currently on the market in that the case includes a border 42 surrounding a mobile phone. The case 40 also includes a grip 44 affixed to a bottom surface 46 of the case, which is shaped to simulate a gun grip and optionally a trigger. FIG. 4 is a front perspective view of the mobile phone 16 inserted within the case 40 of FIG. 3. The mobile phone may then be held by the grip 44. The grip may also include a trigger 48. In an active embodiment, the trigger 48 is coupled electronically, either wirelessly (e.g., Bluetooth) or via a cable or wire to the mobile phone. In this active embodiment, each trigger pull sends an electronic signal to the processor 20 of the mobile phone. In another passive embodiment, the trigger is not coupled electronically to the mobile phone. Actuation of the trigger may be detected by a clicking sound detected by a microphone of the mobile phone. In another embodiment, the mobile phone may not have any grip or trigger and the actuation of the simulated trigger may be by shaking the mobile phone, the player emitting a verbal command, or the player touching a touch screen icon or button. In addition, the case may include a lanyard for ease in carriage of the case and attached mobile phone.

Figure 7:
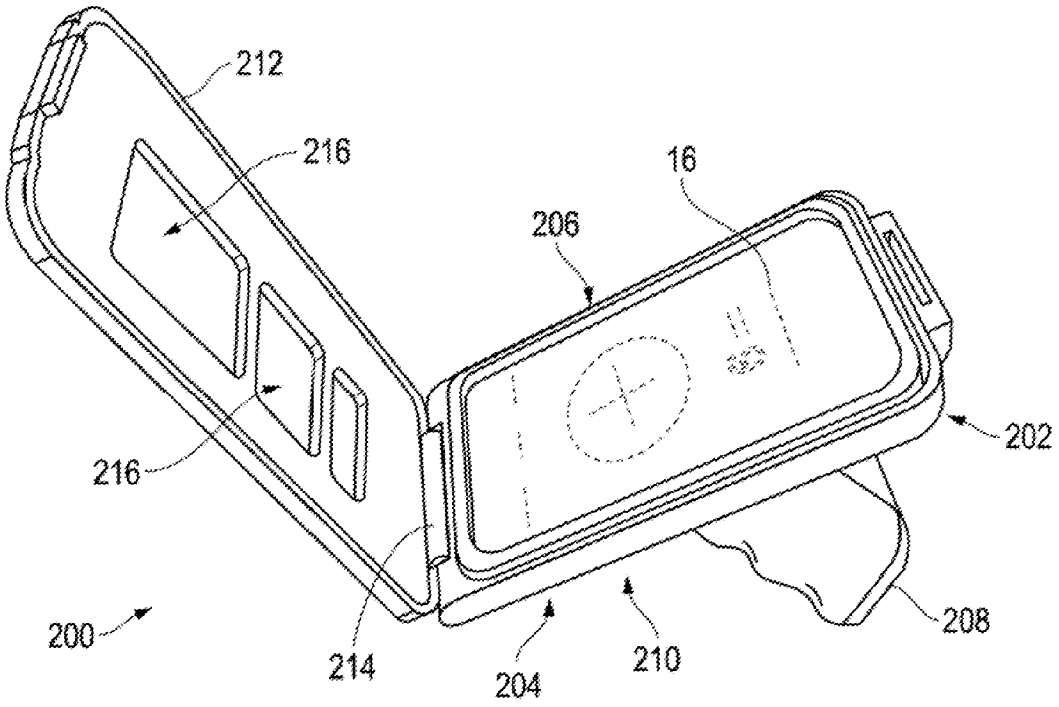
FIG. 7 is a front view of the targeting actuation system in an open configuration in one embodiment of the present invention.

In another embodiment of the present invention, a targeting actuation system 200 may be utilized with the shooting simulation system 10. The targeting actuation system may be any apparatus which enables a user to actuate a simulated firing of the mobile phone 16 or 18 (e.g., a trigger pull for a simulated shooting). FIG. 7 is a front view of the targeting actuation system in an open configuration in one embodiment of the present invention. The targeting actuation system may include a mobile phone case 202 having a main body case 204 with a raised border 206 along a perimeter of the main body case. A hand grip 208 may be attached to a bottom side 210 of the main body case 204. Additionally, a removable cover 212 may be attached to an end 214 of the main body case 204. A mobile phone 16 may be positioned and retained within the raised border 206 of the main body case 204.

Figure 8:
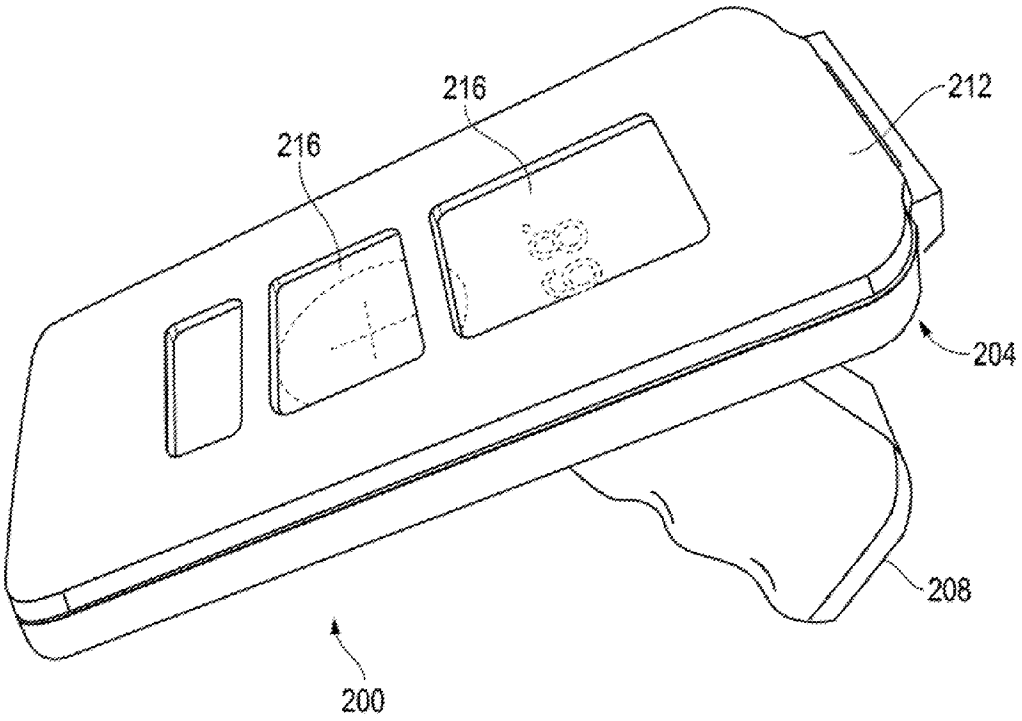
FIG. 8 is a front view of the targeting actuation system of FIG. 7 in a closed configuration.

FIG. 8 is a front view of the targeting actuation system 200 of FIG. 7 in a dosed configuration. In the closed configuration, the cover 212 is positioned over the mobile phone 16. The cover 212 may include a plurality of openings 216 to allow viewing of a portion or portions of the screen of the mobile phone by a user. The primary purpose of the cover is to provide an additional form of protecting the mobile phone. The portion or portions of the screen visible may include specific information necessary for the user during use of the simulated shooting system 10 while the cover covers areas of the screen not relevant for use in the shooting simulation system 10.

In a similar manner as described for the mobile phone case 40, the mobile phone may then be held by the hand grip 208. The grip may also include a trigger (not shown in FIG. 8). The trigger may be coupled electronically, either wirelessly (e.g., Bluetooth) or via a cable or wire to the mobile phone. In this embodiment, each trigger pull sends an electronic signal to the processor 20 of the mobile phone. In another passive embodiment, the trigger is not coupled electronically to the mobile phone. Actuation of the trigger may be detected by a specific sound detected by a microphone of the mobile phone. The specific sound, such as a clicking sound, emits a distinct sound or a specific tonal spectrum. A microphone or other aural receiving device of the mobile phone may detect the sound and the processor 20 may determine if the sound is within an acceptable range of the specific spectrum equating to the trigger. The processor may then perform the action of a trigger pull of the simulated weapon. In another embodiment, the mobile phone may not have any grip or trigger and the actuation of the simulated trigger may be by shaking the mobile phone, the player emitting a verbal command, or the player touching a touch screen icon or button. In addition, the case may include a lanyard for ease in carriage of the case and attached mobile phone.

The targeting actuation system 200 may also include additional or separate positional and directional sensors for use with the shooting simulation system 10. The positional and directional sensors may include magnetometers, accelerometers, etc. for use in determining the orientation and position of the mobile phone. This positional information may be provided to the processor 20. In addition, the targeting actuation system 200 may communicate with other communication devices, such as wearable smart devices, e.g., smart watches, etc. In another embodiment, the positional sensors may also reside in other devices worn by the user, such as wearable smart devices, e.g., watches. Thus, the sensors worn by the user may provide positional information to the mobile phone. In another embodiment, the targeting actuation system 200 may be incorporated in a grip and optional trigger which is not physically connected to the mobile phone. Rather. The grip and optional trigger may be separate. For example, a user may place a mobile phone in a pocket while the user aims and triggers a separate grip and trigger. The trigger may be electronically coupled through a wireless connection with the mobile phone (e.g., Bluetooth) or use the sound of a pulled trigger to initiate the targeting.

In addition, the mobile phone may include an optional display 30 (see FIG. 2) for displaying information to the player, such as hit or miss cues and location of a friendly or opposing player and final game results. Furthermore, the mobile phone may also include an aural system 32 having a microphone and a speaker. The aural system may provide an indication of when a hit has been scored against the player, near miss cues (e.g., right/left verbal warnings or displays on a screen associated with the firearm), a realistic noise simulating the firing of a gun, or bullets approaching. The aural system may also provide a verbal call of the accuracy of the shot, such as "miss", "hit", or "miss right/left".

The present invention may be utilized in a game or simulated combat scenario where players A and B are aligned on opposite sides. The present invention may utilize more than two players and include more than two teams. The players utilized their mobile phones 16 and 18 by aiming the mobile phones at an opposing player and actuating a trigger for simulating shooting at or targeting the opposing player. In one embodiment, the player is simulating direct fire, such as shooting a simulated line-of-sight weapon at the opposing player. In another embodiment, the player is aiming and simulating employing indirect fire, such as designating a target for a strike by a notional airborne drone, utilizing mortars, artillery, helicopters, etc. The mobile phone, through the processor, GPS device and communication with the game server, knows the location of the opposing player. The mobile phone is "aimed" at the opposing player, specifically the mobile phone is longitudinally aligned (directional or azimuth) with the desired target. Upon actuation of the trigger or simulated trigger, the processor may determine the direction of the mobile phone. It may be determined (adjudicated) by the processor of the shooting mobile phone or by the game server having a processor if there would be a hit or miss.

The game server 14 receives location data (e.g., GPS data from each mobile phone) and may independently determine/verify a hit or miss of the target. Since the game server may know the position of each player and the information on the triggered firearm (i.e., the orientation of the mobile phone), the game server may determine/verify a hit or miss. Alternatively, the game server may relay location data of the opposing player's mobile phone to the firing player's mobile phone and enable the processor 20 to determine if the fired shot would have been a hit or miss. Additionally, the game server 14 may manage the location of all the players as well as compiling all the hits and misses of each player at a specific location and time during the simulation. This compilation may be used for debrief of the players and determination of the success of each player and each team. The game server may compile a wide variety of data, such as time of firing, accuracy, number of bullets fired, times the player is targeted, etc. In one embodiment, the game server may provide a playback of each encounter providing a graphical representation of each player, trajectory of the simulated bullets, or targeting of the drone. Furthermore, the game server may send back information on a hit or miss to the intended target. For example, the target and its associated mobile phone may be informed that he is killed by receiving an aural warning. In addition, the game server may determine a size or pattern of what is defined as a "hit" or "miss". Additionally, the game server may provide a handicap based on previous performance of the player for the determination of a hit.

Figure 5:
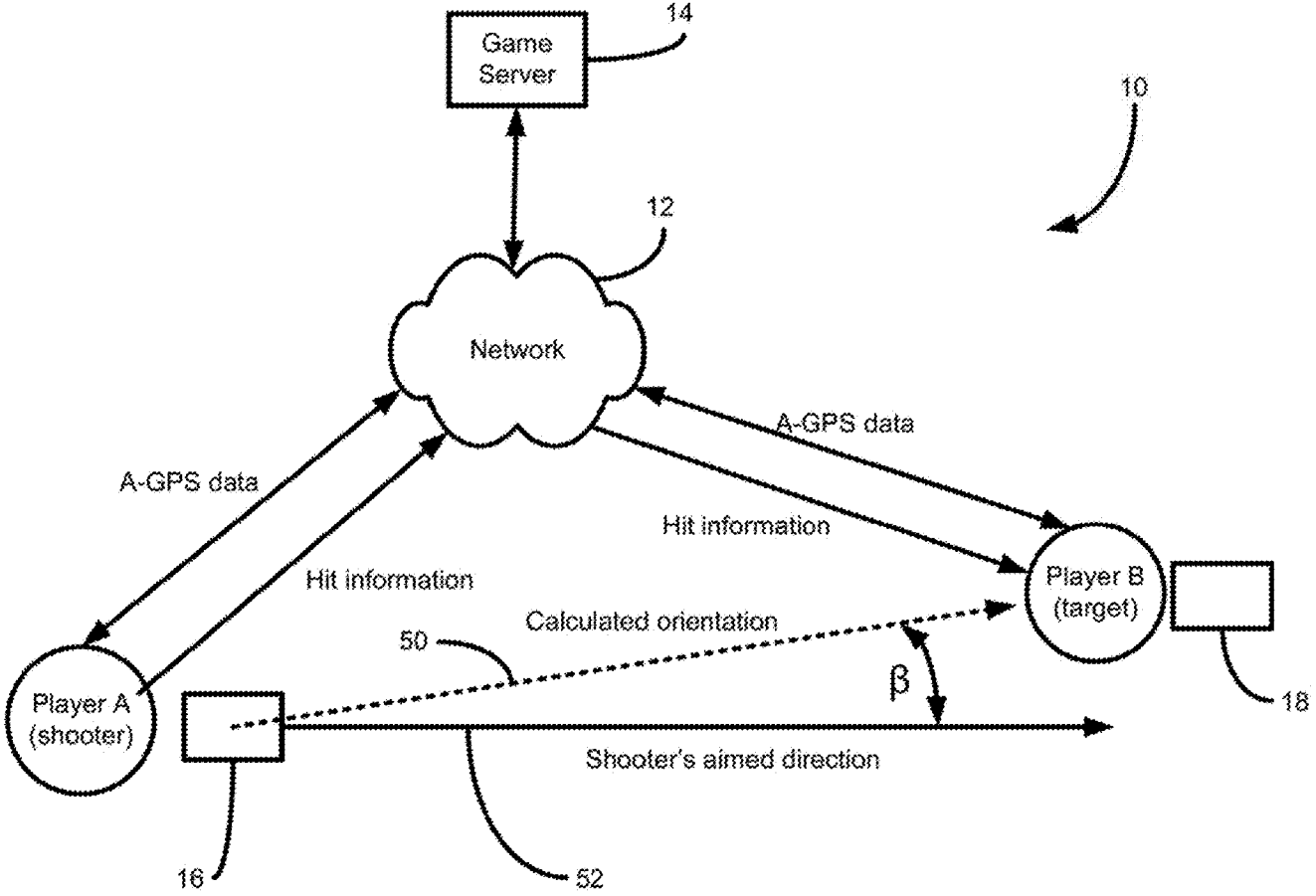
FIG. 5 is a simplified block diagram illustrating the interaction of the components for use in the present invention.

FIG. 5 is a simplified block diagram illustrating the interaction of the components for use in the present invention. With reference to FIGS. 1-5, the operation of the system 10 will now be explained. Each player carries a mobile phone 16 or 18. The mobile phone includes a GPS device 24 to determine the geographical location of the mobile phone. In one embodiment, the geographical information or GPS data is the indicia of the mobile phone and its associated player, which identifies the player. In one embodiment, each player's mobile phone receives the GPS data of the opposing player or players' mobile phones. A player, for example player A as shown in FIG. 5, aims the mobile phone 16 at a target, in this example, player B. The directional mechanism 26, which may be incorporated into the GPS device, ascertains an aimed direction or azimuth 52 for which the mobile phone is aimed. The processor 20, by knowing the location of mobile phone 16 (player A) and mobile phone 18 (player B), can determine a calculated orientation 50 between the two mobile phones. The game server 14 or the shooting mobile phone (e.g., mobile phone 16) may provide a hit criteria, such as a maximum $\beta$ angular error for which a shot would be scored as a hit. The hit criteria may be set in various ways. In one embodiment, the radius of the "kill zone" may be increased or decreased as desired. Alternatively, the simulated bullet may be increased or decreased in size. Also, in one embodiment, rather than simulating a shooting firearm, the present invention may simulate targeting a player with a simulated airborne drone. In either case, a hit is determined by the directional accuracy. In another embodiment, the location of both mobile phones at the time of trigger actuation is sent to the game server which adjudicates whether the shot fired or targeting is a hit or miss. The information of a hit (and optionally a miss) may be relayed to either the shooting player or both the shooting and targeted players' mobile phones. It should be understood that trigger actuation refers to any shooting or targeting of an opposing player. Trigger actuation may be accomplished in a wide variety of ways. For example, the player may shake the mobile phone, touch a touch screen icon, emit a yell or other sound, etc. In addition, the mobile phone may be inserted into the mobile phone case 40 which includes a grip 44. This case may be used to allow ease in carriage of the mobile phone as well as provide ease in aiming the mobile phone at a target. The grip may also include a trigger which may be either passively or actively connected to the mobile phone. For an active connection, the trigger 48 may be electronically coupled to the mobile phone (e.g., Bluetooth), which would register as a trigger pull. In the passive connection, there is no electronic connection between the trigger and the mobile phone. In one embodiment, the mobile phone may register a trigger actuation upon hearing a distinctive click from the trigger when pulled. In another embodiment, the present invention may utilize the trigger system 200 to enable the user to actuate the trigger. In any case, trigger actuation is used to simulate either shooting the simulated firearm or targeting a player for attack by a notional airborne drone. The hits and/or misses may be relayed to the game server for a total tally by the game server. The communication between the mobile phones and the game server may utilize any wireless network, such as a telecommunications network.

Figure 6A:
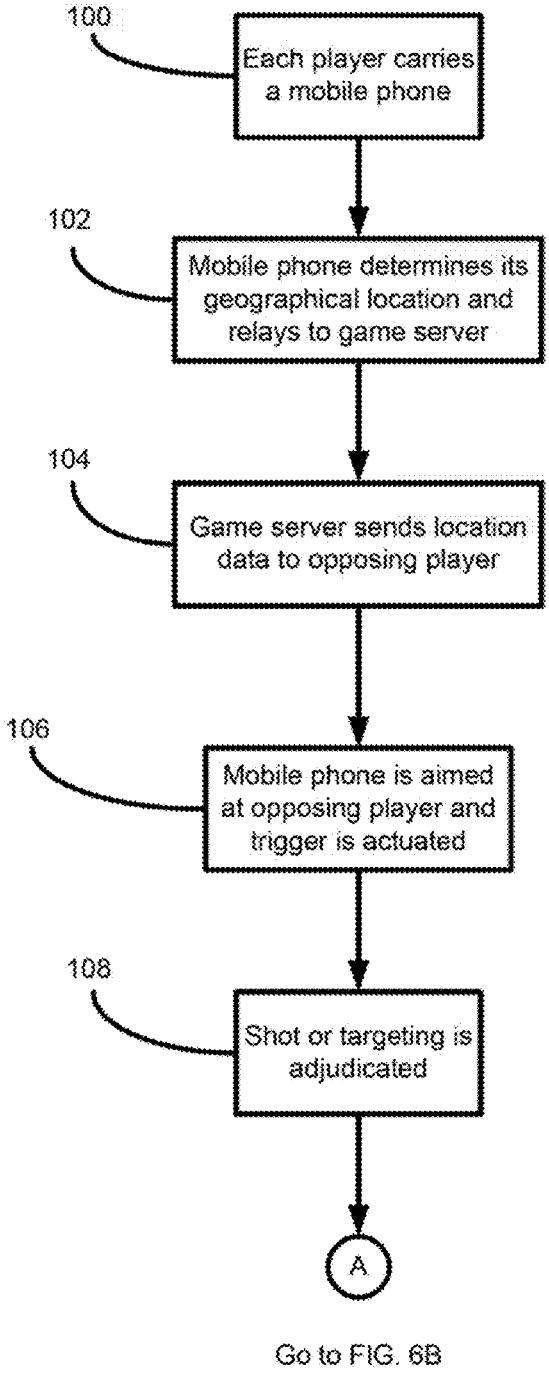
FIGS. 6A and 6B are flowcharts illustrating the steps of utilizing the system according to the teachings of the present invention.
Figure 6B:
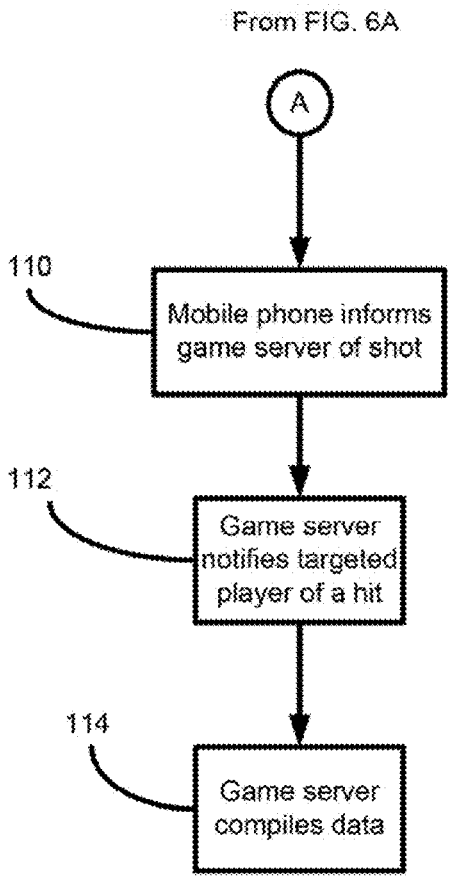

FIGS. 6A and 6B are flowcharts illustrating the steps of utilizing the system 10 according to the teachings of the present invention. With reference to FIGS. 1-6, the method will now be explained. In step 100, each player carries a mobile phone 16 or 18. In step 102, each mobile phone continually determines its geographical location or indicia and relays this information to the game server. In step 104, the game server 14 sends the opposing player's location information (indicia) to the other player (e.g., player B's geographical location is sent to player A's mobile phone). The opposing player's geographical information may optionally be displayed to the player for providing situational awareness of a general directional orientation of the player. In step 106, player A aims the mobile phone 16 at player B and actuates the trigger. The trigger may be a trigger 48 or actuated in a wide variety of ways, such as shaking the mobile phone or touching an icon on the mobile phone display. Next, in step 108, the shot or targeting is adjudicated. In one embodiment, the processor in the shooting player's mobile phone 16 adjudicates if the shot or targeting was a hit or miss. In another embodiment, the game server receives the aimed direction 50 and true orientation 52 and determines if the shot or targeting was a hit or miss. In step 110, the mobile phone 16 may inform the game server of the shot or targeting and optionally the results (i.e., hit or miss) for tally by the game server. The hit or miss information may then be relayed to the targeted player's mobile phone 18. Next, in step 112, the game server 14 may inform the targeted player B's mobile phone 18 of a hit. The mobile phone may be informed by either aural feedback (e.g., sound indicated that player B has been hit) or visual feedback (e.g., visual signal on display 30). In step 114, the game server 14 may then manage the location of all the players as well as compiling all the hits and misses of each player at a specific location and time during the simulation. This compilation may be used for debrief of the players and determination of the success of each player and each team. The game server may compile such data as time of firing, accuracy, number of bullets fired, times the player is targeted, etc.

The present invention provides many advantages over existing shooting simulation systems. The present invention does not require the wearing of sensors by players to detect a hit by an IR emitter or other device. Furthermore, the targeted player does not need to emit an active electronic emission and may be a passive target. Additionally, the shooting simulated firearm does not need to emit any spectral emissions to determine if the image is a legitimate target. Thus, the cost of equipment is drastically reduced. The present invention may be incorporated in existing mobile phones.

The present invention may be utilized between two players or multiple players on two or more teams. The present invention may be used as a shooting simulation system and method by a simulated shooting firearm or by a device for targeting a player with a notional airborne drone. In addition, the present invention may be used as a live action, real world game similar to Laser Tag, but more competitive and more tactical. The only electronic device required to play is a mobile phone with an incorporated app. It may be played outdoors as a multi-player, force-on-force game. Unlike Laser Tag it is not dependent on direct fire, line of sight shots only. It may also use the mobile phone's GPS and orientation sensors for direct and indirect fire scenarios. This geo-based, position aware system enables the creation of virtual weapons and real world zones and boundaries. Offense can include air support, artillery, and attack drones. Defense may be from bunkers, foxholes, stealth mode and anti-aircraft weapons. Field features can include bases, targets, minefields, and re-arming sites. The game can be played casually with no virtual field features or players can create elaborate battlefields integrated into real world terrain. Once a field is established it can be kept in memory for subsequent visits. As discussed above, the present invention may be played with just a mobile phone by pressing fire buttons, or for the more serious player a phone case with a pistol grip and trigger is available as an accessory.

In another embodiment, the present invention is an error correction system and method for a simulated shooting system. As discussed above, there are inherent errors caused by positional (e.g., GPS) and directional mechanisms (e.g., magnetometers) utilized by the mobile phone. Both of these types of sensors can produce combined aiming errors of 25 degrees in worst case situations (e.g., when the shooter position, target position, and mobile phone orientation errors are all in the same direction). These errors have a tendency to persist resulting in well aimed shots missing in the same direction (e.g., left or right). The present invention may utilize the processor 20 of the mobile phone or game server 14 to calculate an error correction with consideration to the shooter/target movement, shot history, and other factors to adjust the virtual trajectory or size of the virtual bullet for more realistic results.

Figure 9:
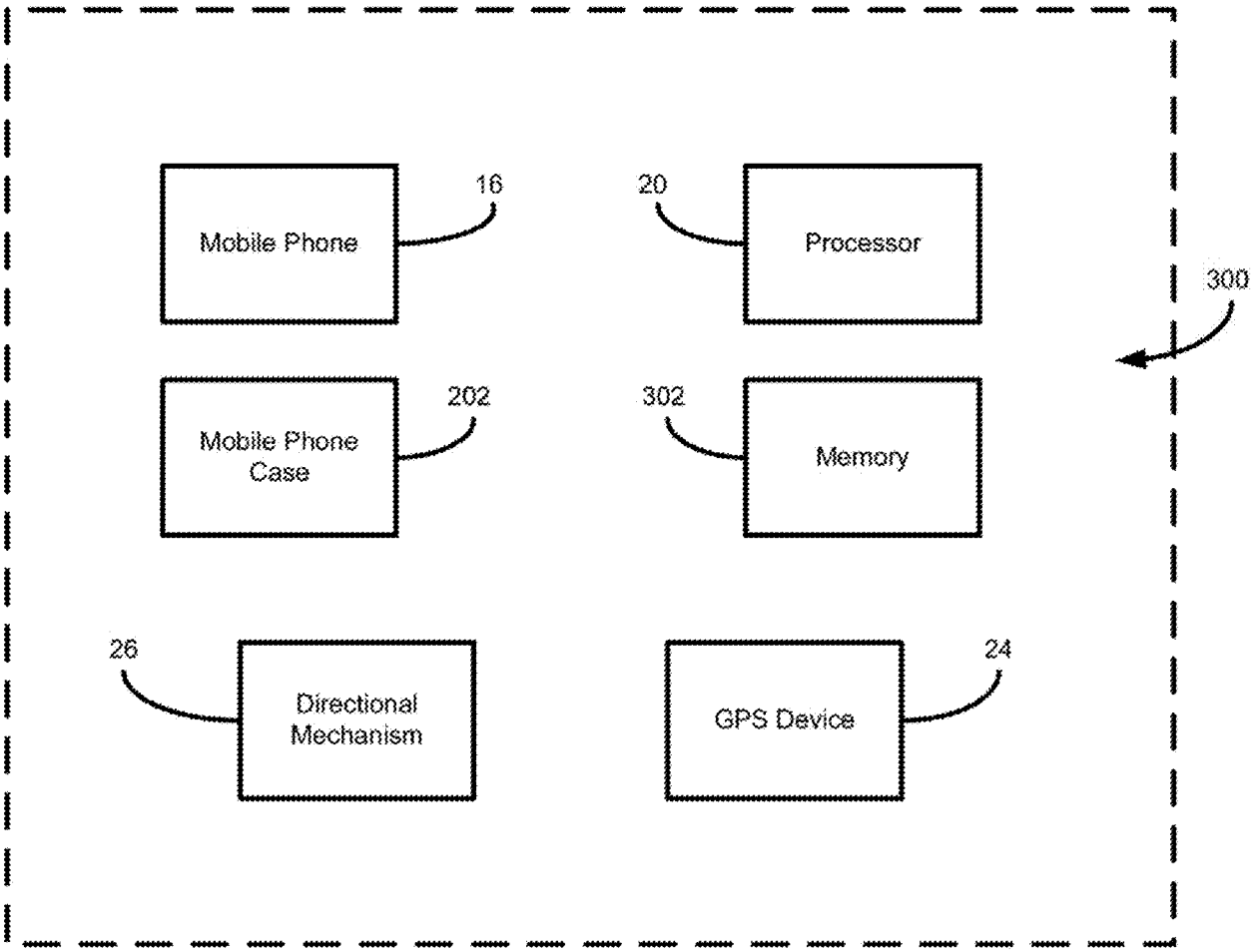
FIG. 9 is a simplified block diagram of an error correction system in one embodiment of the present invention.

FIG. 9 is a simplified block diagram of an error correction system 300 in one embodiment of the present invention. The error correction system may utilize information obtained from the mobile phone having a GPS device 24 and a directional mechanism 26. The mobile phone may also include a mobile phone case 40 or 202, or a wearable electronic device (e.g., smart watch). The error correction system may also include a processor, such as the processor 20 residing in the mobile phone. Alternatively, the processor may be located in a mobile phone case, other electronic device worn by the user, or within the game server 14. Additionally, the system 300 may include a receiver for gathering historical data (e.g., the processor) and memory 302 for storing historical data of the phone or the user.

The error correction system 300 utilizes different information for determining an error correction for the shooting simulation system 10. The error correction system may use historical data to determine a valid error. For example, the historical data may be historical data of shots taken by a specific communication device (shot historical data). Shots taken may have a consistent error in one direction, which would indicate an inherent, and thus valid, error found in the directional system. However, if the shot historical data indicates a wide range of errors in both directions, the error may be caused by inaccurate shooting of the user and not errors caused by the directional mechanism of the mobile phone.

The processor may utilize this shot historical data to determine if an error correction is necessary and appropriate based on the historical data (i.e., historic accuracy of the shots taken). The error correction system 300 may also use historical data of the mobile phone, and/or directional mechanism and GPS to ascertain if a consistent error is present. Additionally, the system errors may be different for different directions. Evidence has shown that errors may differ depending on the direction where the mobile phone is aimed. For example, the direction of the aimed mobile phone may result in a consistent error of 10 degrees to the left when aiming North while an error of 15 degrees to the right is present when aiming South. For any type of the historical data gathered by the error correction system, the processor may use analysis for a predetermined period of time, preferably for the period of the game being played. The historical data may then be stored in the memory 302.

The error correction system may also use information on whether the mobile phone is carefully aimed or rapidly moved to a firing position. Evidence has shown that carefully aimed shooting results in less inaccuracies caused by shooter, which is indicative of any errors being caused by the positional or directional mechanisms of the mobile phone while rapid movement of the mobile immediately prior to shooting tend to result in inaccurate shooting caused by the user and not caused by an orientation system.

The error correction system may utilize shot and system historical data and the movement of the mobile phone prior to shooting to determine a valid and consistent error. Thus, the error correction system may ascertain an appropriate error correction caused by the equipment within the mobile phone and not errors caused by other sources (e.g., inaccuracies caused by the shooter). The processor 20 may then access the memory to use the shot and system historical data. The processor may then calculate an error correction for use. The error correction may be dependent upon the user, mobile phone, and/or direction of fire by the user. The error correction may be used by the shooting simulation system to provide a correction to an aimed shot. Referring to FIG. 5, the processor 20, by knowing the location of mobile phone 16 (player A) and mobile phone 18 (player B), can determine a calculated orientation 50 between the two mobile phones. The game server 14 or the shooting mobile phone (e.g., mobile phone 16) may provide a hit criteria, such as a maximum β angular error for which a shot would be scored as a hit. This maximum β angular error may be adjusted with the correction error to show a more appropriate hit zone. For example, if it is determined that there is an error of 10 degrees left, the processor may provide a right 10 degree correction for determination by the shooting simulation system 10 if a hit should be scored (e.g., adjust β angular error). Likewise, the size of the virtual bullet may be adjusted to calibrate the shot (e.g., larger virtual bullet results in a hit).

With reference to FIG. 9, the error correction system 300 will now be explained. First, recent shot historical data is gathered for a specific period of time (e.g., data accumulated during the game). Next, historical data of the system (i.e., of the mobile phone, GPS, and the directional mechanism) is gathered for a specific period of time. Furthermore, for the shot being examined on error correction, the movement of the mobile phone prior to the shot is gathered. The motion of the mobile phone can be determined prior to the shot and determined if a shot is carefully aimed or a shot is taken rapidly. An error correction may be implemented based on a carefully aimed shot while an error correction is disregarded for rapidly aimed shots. The historical data and motion of the mobile phone prior to shooting may be analyzed and weighted for the determination of an error correction by the processor or game server. The processor then implements the error correction to provide a more accurate determination of a hit or miss. For example, if a shot is determined to be off by 10 degrees to the left, the processor determines an appropriate correction to the right dependent on the shot history, the inherent historical errors of the positional and directional devices, and whether the mobile phone was carefully or rapidly aimed.

Figure 10:
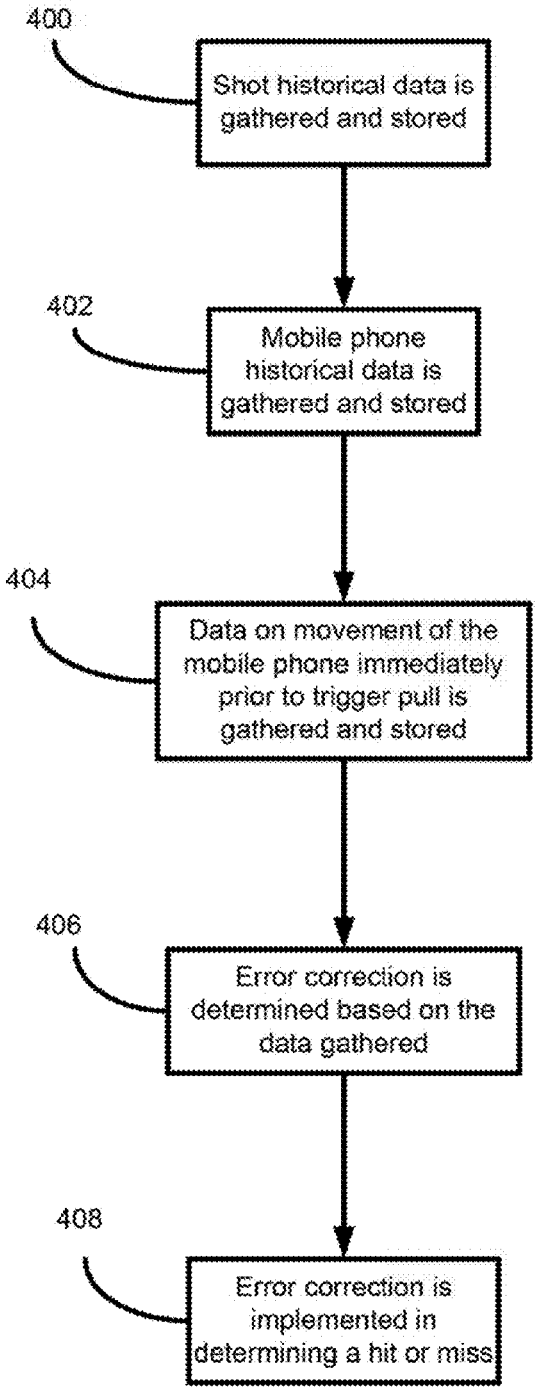
FIG. 10 is a flow chart of the method of the error correction system for determining and implementing an error correction for the shooting simulation system.

FIG. 10 is a flow chart of the method of the error correction system 300 for determining and implementing an error correction for the shooting simulation system 10. With reference to FIGS. 1-10, the method will now be explained. The method begins with step 400 where shot historical data is gathered and stored in the memory 302. The shot historical data may be data of hit or misses from previous shots by the user or users of a specific mobile phone. The historical data may be examined for a predetermined time period, such as for the ongoing game being played. The user historical data is used to determine if an error is caused by the user/users of the specific mobile phone or by the equipment used (mobile phone). If the shot historical data shows a wide range of misses varying from side to side, this may be indicative of a poor shooter. On the other hand, if the historical misses show misses in a consistent area, such as 10 degrees left of target, this is indicative of a good shooter having error problems caused by the equipment used by the user. Next, in step 402, historical data from the specific mobile phone is gathered and stored in the memory 302. The historical data may include previous hits and misses for a predetermined period of time, such as ongoing game. Furthermore, the historical data may include the direction of the shot as well as the distance of any miss. This historical data is examined to determine any consistent error inherent with the specific mobile phone. In step 404, data concerning movement of the mobile phone just prior to the shot is gathered and stored in the memory 302. The movement of the mobile phone prior to a shot can be indicative of a well aimed shot probably resulting in an accurate shot while a rapid motion prior to the shot is indicative of an inaccurate shot. If a rapid motion is detected prior to a shot, the processor may determine that an error correction is not necessary because the rapid prior motion is indicative of an inaccurate shot. In any case, the processor may utilize this information for determining if an error correction is appropriate. Next, in step 406, the present invention may utilize some or all of the data collected, place an error correction based on the gathered data. In step 408, the processor may implement an error correction for determining if a shot is a hit or miss. For example, if a shot is determined to be off by 10 degrees to the left, the processor determines that a miss to the left by 10 degrees would be counted as a hit.

The present invention is an error correction system which may be used to correct errors related to the mobile phone (e.g., GPS errors and direction mechanism errors). The present invention may utilize relevant historical data from previous shots taken by the mobile phone, the motion of the mobile phone prior to the shot being examined and the historical data of hits and misses of a specific mobile phone for use in determining an appropriate error correction. The error correction system may be utilized in any point and shoot system having historical data of previous hits and misses.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An error correction system for a shooting simulation system, the error correction system comprising:

a mechanism for gathering and storing historical data of a communication device utilized in a shooting simulation system, the historical data including hit and miss results of the communication device in a targeting of a target over a predetermined period of time;

a processor for analyzing the historical data of the communication device to determine directional errors caused by magnetometer of the communication device during targeting of a target;

wherein the processor determines an error correction to correct the directional errors caused by the magnetometer, the processor implementing the error correction to determine a hit or miss of a targeting of a target by the communication device.

2. The error correction system according to claim 1 further comprising a mechanism for gathering and storing historical data of shots by a shooter of the communication device, the shot historical data hit and miss results of the shooter of the communication device in a targeting of a target over a predetermined period of time.

3. The error correction system according to claim 2 wherein the shot historical data is analyzed by the processor to determine errors attributed to the shooter.

4. The error correction system according to claim 3 wherein the processor utilizes the shot historical data and the communication device to determine an appropriate error correction based on the accuracy of the shooter of the communication device.

5. The error correction system according to claim 1 further comprising a mechanism for determining movement of the communication immediately prior to targeting a target.

6. The error correction system according to claim 5 wherein the processor utilizes information on any detected rapid movement of the communication device immediately prior to targeting a target to determine an appropriate error correction.

7. The error correction system according to claim 1 further comprising:

a mechanism for gathering and storing shot historical data of the communication device, the shot historical data of the user including hit and miss results of the shooter of the communication device in a targeting of a target over a predetermined period of time; and a mechanism for determining movement of the communication immediately prior to targeting a target.

8. A method of implementing an error correction for a shooting simulation system utilizing a communication device for targeting of a target, the method comprising the steps of:

gathering and storing historical data of the communication device utilized in a shooting simulation system, the historical data including hit and miss results of the communication device in a targeting of a target over a predetermined period of time;

analyzing the historical data of the communication device to determine directional errors caused by a magnetometer of the communication device when aimed;

determining an error correction to correct directional errors caused by the magnetometer of the communication device; and implementing the error correction to determine a hit or miss of a targeting of a target by the communication device.

9. The method of implementing an error correction according to claim 8 further comprising the step of gathering and storing historical data of shots taken by a shooter of the communication device, the shot historical data including hit and miss results of the shooter of the communication device in a targeting of a target over a predetermined period of time.

10. The method of implementing an error correction according to claim 8 wherein the step of determining an error correction includes determining if any errors are attributed to the shooter.

11. The method of implementing an error correction according to claim 10 wherein the step of determining an error correction includes utilizing the shot historical data and the communication device to determine an appropriate error correction based on the accuracy of the shooter of the communication device.

12. The method of implementing an error correction according to claim 8 further comprising the step of determining movement of the communication immediately prior to targeting a target.

13. The method of implementing an error correction according to claim 12 wherein the step of determining an error correction includes utilizing information on any detected rapid movement of the communication device immediately prior to targeting a target to determine an appropriate error correction.

14. The method of implementing an error correction according to claim 8 further comprising the steps of:

gathering and storing shot historical data of a shooter of the communication device, the shot historical data including hit and miss results of the shooter of the communication device in a targeting of a target over a predetermined period of time; and determining movement of the communication immediately prior o targeting a target.

* * * * *